United States Patent [19]

Bryant

[11] 4,109,592

[45] Aug. 29, 1978

[54] MENDING YARN IN THE SELVEDGE OF TUFTED CARPETING

[75] Inventor: Clifford Aldene Bryant, Dalton, Ga.

[73] Assignee: West Point-Pepperell, Inc., West Point, Ga.

[21] Appl. No.: 745,974

[22] Filed: Nov. 29, 1976

[51] Int. Cl.[2] ..... D05C 15/34

[52] U.S. Cl. ..... 112/79 A

[58] Field of Search ..... 112/79 R, 79 A, 79.5, 112/79 FF, 78, 80, 410, 411, 266; 68/203; 28/29, 18, 72.16, 72 P

[56] References Cited

U.S. PATENT DOCUMENTS 2,001,527 5/1935 Davison ..... 112/410 X 2,857,651 10/1958 Keen ..... 28/72.16

4,015,550 4/1977 Bartenfeld et al. ..... 112/79 A

*Primary Examiner*—H. Hampton Hunter

*Attorney, Agent, or Firm*—Davis, Hoxie, Faithfull & Hapgood

[57] ABSTRACT

In the manufacture of tufted carpets from a sheet of yarns which are dyed along their lengths at different positions with different colors, mending yarns are provided at the edge of the sheet which are dyed in segments along their length using the same dye colors as the yarns in the sheet. The mending yarns are tufted into the selvedge of the carpet where they can be pulled out for use in mending the carpet when dropped stitches occur.

20 Claims, 4 Drawing Figures

MENDING YARN IN THE SELVEDGE OF TUFTED CARPETING

This invention relates to machines for manufacturing multi-colored tufted carpet. More particularly, it relates to providing mending yarns of the same color as the yarns in the carpet which can be used during the manufacturing process to repair or mend the carpet where a yarn has broken or a series of skipped stitches appear along a row lengthwise of the carpet.

It frequently happens in the carpet manufacturing process during the running of a tufted machine that one or more yarns may break. Before the break is noticed and the machine is stopped, the needle bar of the machine will reciprocate many times. The needle which was carrying the yarn that broke will thus enter and withdraw from the backing or foundation sheet without the yarn, thus leaving a blank space longitudinally of the carpet. So that a flaw will not appear in the finished carpet, it is necessary to tuft into the backing sheet, individually stitches or loops with the use of a conventional hand-held mending machine.

Mending machines are well known and commonly used in manufacture of tufted carpeting and need not be described herein, particularly since the present invention relates to the production of yarns for use in mending and not to the mending machine itself or to the use thereof.

Mending machines are manually carried and operated by a repairer. As the flaw is noticed, the repairer starts the mending machine and moves it along the row where the stitches are absent. Because the carpet is moving very slowly, the tufting machine need not be stopped during mending. The mending machine has yarn of the proper color to match up the dropped or absent stitches or loops to maintain the carpet pattern.

In machines like that described in Bartenfeld et al. U.S. application Ser. No. 603,930, filed Aug. 12, 1975, patented Apr. 5, 1977, with U.S. Pat. No. 4,015,550 a sheet of yarns is fed to dyeing apparatus prior to moving onward to a drying chamber and to the needles of a tufting machine. In the dyeing apparatus a plurality of different dyes are applied to the individual yarns along their length in spaced segments. These yarns after being dried are fed to a tufting machine and are needled into the backing sheet to form the carpet, producing a predetermined pattern therein in accordance with, and as a result of the differently dyed segments.

Since it cannot be known in advance what the color of the yarn will be when a break occurs, it is necessary to have yarn available, dyed exactly the same color as should have appeared in the row had the break not occurred and the blank space not appeared.

Because several different dye colos may be used in dyeing the yarn and the yarns bearing these colors will appear in carpets, it is necessary to have all the colors available in the mending yarns.

The invention is particularly adapted for use in the manufacture of tufted carpets of the kind in which yarns are space-dyed or dyed individually, in pairs or in groups at predetermined positions along their length with different colors selectively along their lengths in segments according to a predetermined complex pattern, and the yarns, after dyeing, are subsequently fed to the needles of a tufting machine, whereby to produce a carpet with a predetermined complex pattern.

It will be understood, however, that the invention is not limited to such use but may be useful elsewhere wherever there is a need for mending yarn having colors identical to those appearing in the carpet or other textile fabric. Moreover, the invention is not limited to a carpet making method in which the dyed and dried yarns are immediately fed to the tufting machine. The invention may be used when the yarns are wound on a beam, later to be fed from the beam to the tufting machine.

It is an object of this invention to provide mending yarns which are dyed with the same dyes at the same time as the yarns in a sheet of yarns are being selectively dyed with different colors along their lengths preparatory to use of the yarns of the sheet in the manufacture of tufted carpets.

Another object is to provide apparatus for feeding one or more mending yarns alongside a sheet of yarns as the sheet is fed to dyeing apparatus in the process of preparing the sheet for use in a tufting machine to produce a predetermined multi-colored carpet, and to dye said mending yarn simultaneously with the dyeing of the yarn sheet with the same colors in spaced segments of colors, so that such mending yarns will be available for use to repair or mend the carpet during the carpet manufacturing process. Other objects and advantages of the invention will appear as the invention is described in connection with the accompanying drawings.

Figures 1, 2, 3, 4:
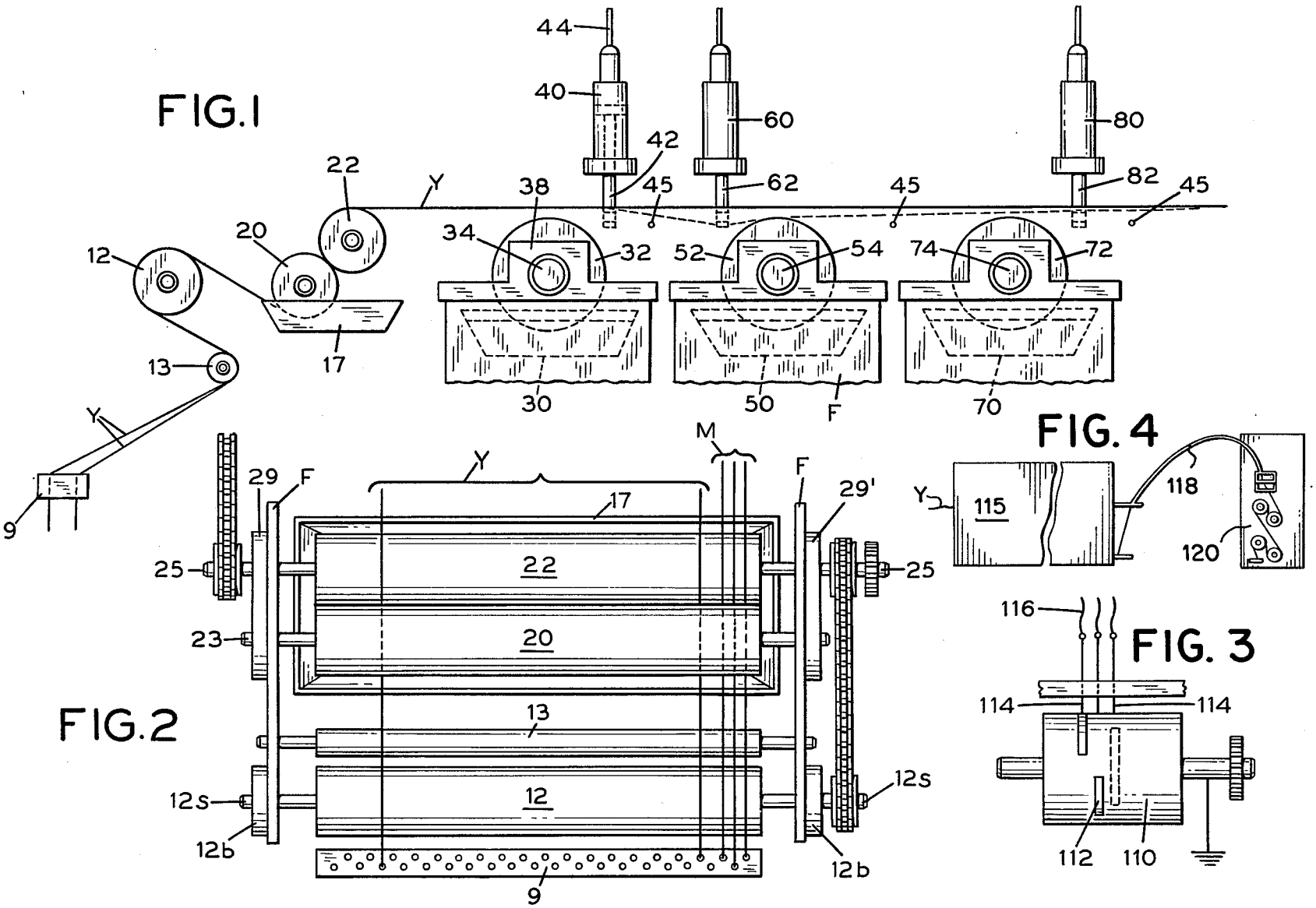
FIG. 1 is an elevational view showing diagrammatically the method and apparatus embodying the invention.
FIG. 2 is a plan view of the end of the apparatus of FIG. 1 where a sheet of yarns and the mending yarns enter the apparatus for treatment and dyeing.
FIG. 3 is a fragmentary diagrammatic view of the electrical control drum which activates the dye control elements for the mending yarns.
FIG. 4 is a diagrammatic illustration of the drying apparatus and tufting machine used in practicing the invention.

In copending application Ser. No. 603,930, U.S. Pat. No. 4,015,550, apparatus is described of the kind with which this invention is particularly useful. Reference may be had to said application and patent for full background details of the structure to which the present invention is applied.

Referring to the drawings, the yarns Y from a creel or spools, spread into the form of a sheet, are threaded up through a horizontal yarn guide plate 9 having several rows of staggered holes, from which the yarns pass around a horizontal idler roll 13 and around and over a parallel draw roll 12 mounted on a horizontal shaft 12s supported in bearing 12b in the machine frame F above the idler roll 13. The draw roll has a rough surface and is power driven and pulls the yarns from the supply at a regular controlled rate, in effect metering the supply as will hereinafter more fully appear.

The machine frame F may be of any suitable form and number of parts to support the various elements of the machine as described herein.

The yarn sheet when composed of certain kinds of yarns, may, if desired, pass from the draw roll 12 into a pretreatment bath 17 under the first (20) of a pair of parallel horizontal squeeze rolls 20, 22 which are mounted on shafts 23, 25 journalled in bearings in bearing blocks 29, 29' supported from the machine frame at each end of the rolls.

From the squeeze rolls 20, 22, or directly from draw roll 12 if the pretreatment bath is omitted, the yarns go directly to dyeing apparatus which in the example illustrated is provided with means to apply three colors in succession at spaced points along each individual yarn end, or pair or small group of yarn ends.

Some yarns are of such composition that they do not require the pretreatment.

In order to apply dye at spaced positions along the yarns, three (or more or less) identical stainless steel dye-pick-up rolls 32, 52, 72, are provided, mounted on shafts 34, 54, 74, and positioned over troughs 30, 50 and 70 containing dyes of different colors and additive chemicals to assist adherence of the dyes to the pick-up rolls, to penetrate the yarn, to fix the dye to the fibers and to reduce foam. The lower part of each roll is immersed in the bath and picks up dye as the roll turns. The shaft 34 of roll 32 is journalled in bearings in bearing blocks 38. The trough 30, bearings and roll 32 are supported in such a way as to be removable as a unit sidewise from the machine as will presently be described. The rolls 52 and 72 are similarly supported and positioned with respect to their dye troughs and are removable.

Above each pick-up roll is mounted a bank of yarn-end-manipulating assemblies located in one, two or more parallel rows extending parallel to the rolls.

Each yarn-manipulating assembly comprises a vertically mounted pneumatic cylinder such as 40 containing a plunger with a stem or piston rod such as 42 extending out the lower end in a position offset from directly-vertical position over the roll. The plunger and roll are normally biased upwardly by a coiled compressing spring within the cylinder 40. A conventional electromagnetically operated solenoid valve (not shown) controls inlet and exhaust of air to and from the cylinder through a connection such as 44 to an air supply.

The details of the pneumatic assemblies and solenoid valves need not be described since they are known pieces of equipment having been available on the market and used for various purposes in various machines (see Hackney et al. U.S. Pat. No. 2,954,865).

The individual yarn ends (or pair of ends in the example being described) pass through openings at the lower end of the downwardly extending portions of the piston rods. These openings are peferably apertures with straight horizontal bottom edges and generally of rectangular shape. Alternatively the openings may have open bottoms. Each of the assemblies is placed so that when its piston and rod are down, the yarn end or ends it carries will be pushed down into contact with the adjacent pick-up roll. More specifically, the first assembly controls the position of the yarn Y between the squeeze roll 22 and itself. In the inactivated position the rod 42 is up, in the position shown in FIG. 1, and the yarn is out of contact with the pick-up roll 32. When activated, the rod 42 moves down carrying the yarn into contact with the pick-up roll 32.

In corresponding fashion when the rod 62 of the second assembly is inactivated (up, as shown in FIG. 1), the yarn is held from contacting the roll 52, whether or not the first assembly is activated. But when the second assembly is activated, the rod 62 moves down and carries the yarn into contact with the pick-up roll 52 as shown in dashed lines in FIG. 1.

And, likewise, when rod 82 of the third assembly is up, the yarn is held from contacting the third pick-up roll 72, whether or not the rod 62 of the second assembly is activated.

Since the yarn is constantly moving forward through the machine, the yarn end will be dyed with different colors along its length. The places where a particular color is applied will depend upon when the particular dye assembly is activated. The length of the stretch or segment that is dyed will depend on how long the activation continues and how fast the yarn sheet is moving.

If desired, a sagging yarn or a broken yarn may be supported in various ways, such as by a thin wire 45 stretched horizontally across the machine at convenient points.

Control of the solenoid valves which activate the pneumatic yarn-manipulating assemblies may be by a power driven rotating pattern drum (not shown) with conductive fingers rubbing over conductive and non-conductive portions of a pattern laid out on the surface of the drum.

Alternatively, other pattern controls may be employed, of which the digital pattern control as disclosed in the Strother et al. U.S. Pat. No. 3,772,434 assigned to the assignee of this application is only one example.

After the final dye assembly has been passed by, the yarn sheet goes into a conventional drying chamber 115 wherein the yarns are thoroughly dried.

After drying, the yarns are fed to a conventional tufting machine 120 along equal length paths through guide tubes 118 or otherwise, as described in said application Ser. No. 603,930, U.S. Pat. No. 4,015,550 to which reference may be had for details, no further description being needed herein for the known background apparatus of this invention.

Referring to FIG. 2, several yarn ends M, issuing from the holes of the yarn guide plate 9 at one (right) end, form a group which will become mending yarns. In the embodiment illustrated there are three yarns in the group, but the group may comprise more or less depending on estimated needs. Instead of having all the yarn ends of the mending group at one end of the yarn guide plate as shown, one or more may be at the opposite (left) end of the guide plate.

The yarn ends of the mending group M pass around the draw roll 12 (and around the squeeze rolls 20, 22 if they are used) in the same way as the yarns of the yarn sheet Y. The mending group of yarns are also threaded through a set of piston rods 42, 62 and 82 of the pneumatic cylinders 40, 60 and 80 in a similar manner to the yarn ends of the yarn sheet Y. Ordinarily one set of cylinders, one for each color, will suffice for several or all of the mending yarn ends, depending on the yarn thickness.

The dyeing of the yarns forming a mending group is accomplished by admission of compressed air into the pneumatic cylinders 40, 60, 80 when electric solenoid valves are activated, in similar manner to the control of the dyeing of the yarn ends of the yarn sheet Y. However, in the case of the mending yarns, dyeing in strict accordance with pattern requirements is not necessary. On the contrary, the length of the segment dyed with a particular color depends on other considerations, such as the length, which experience has taught to be necessary in order to have an adequate amount of the particular color for ordinary mending requirements.

For controlling the dyeing of the segments of the yarns a rotating drum 110 may be provided, with peripheral electrically conductive segments 112 wiped over by electrically conductive fingers 114. These fingers are connected by electric wires 116 to the solenoids of individual solenoid valves which control the air-flow to, and exhaust from, pneumatic cylinders like the cylinders 40, 60, 80. For each yarn or group of mending yarns there will be a cylinder for each color so that the mending yarn or a group thereof may be lowered into contact with the dye rolls 32, 52, 72 selectively to dye segments of yarn with the different colors along the lengths of the yarns. If the yarn thicknesses permit, all the mending yarns of the group can be bent down at once by one plunger and dyed at once with the color. If the thickness of the yarns of the group will not permit this, then more than one cylinder and plunger will be necessary; but they can be operated simultaneously by one finger and its conductive strip on the drum 110 so that, viewed transversely, all the mending yarns will simultaneously be dyed one color. The position of the conductive strips on the drum will be located so that the dyeing of segments of the different colors along the yarns will occur in such a way as not to overlap. The color segments in the group M of mending yarns will not be identical in length and position with any yarns in the sheet Y, except perhaps in a rare or exceptional instance, because the objective and providing the dyed mending yarns is different from the objective when selectively dyeing the yarns in the sheet. In the latter case a pattern in a carpet is to be produced by a tufting machine from the yarns of the sheet, whilst in the former case yarns of identical color are to be created for mending or repairing dropped or absent stitches or loops in the pattern in the carpet issuing from the tufting machine.

The location of the mending yarns in the selvedge of the carpet is convenient not only because of the proximity of the mending yarns but also because the selvedge is cut off in the course of final manufacture of the carpet.

The dyeing of the mending yarn, occurring simultaneously with the production of selective dyeing of the yarns in the sheet, enables the yarns in the sheet and the mending yarns to be dried simultaneously and carried on to the tufting machine where they are simultaneously needled into the backing sheet. The nature of the carpet tufting process enables the required amount of mending yarn to be pulled out of the backing sheet without difficulty and used in the mending machine.

From the foregoing it will be apparent that the invention provides a means for producing mending yarns of colors identical to the colors of the yarns in the carpet pattern, thereby enabling a more perfect product to be produced while at the same time saving time and labor due to the proximity and availability of mending yarns to the repairer.

It is within the scope of the invention to use not only the rotary drum pattern control and the digital pattern control above mentioned but also a continuous movable element, such as a belt, having on its surface pattern indicia which can be physically engaged, or read without physical engagement by light-sensitive cells ("electric eyes") or through light-conductive rods in a fashion known in the art.

Likewise the movement of the mending yarn guides may be under control of a continuous movable element, such as a belt, having indicia on its surface which can be physically engaged, or read without physical engagement by light-sensitive cells or through light-conductive rods, as above mentioned in connection with the pattern control for the carpeting.

Moreover, under such control means, the yarn guides for all the colors may be simultaneously operated to dye all the mending yarns with segments of different colors simultaneously. However, in such case the length of the different colored segments will be restricted to the distance between one pick-up roll and the nearest neighboring roll.

Whilst the fabric of the carpet may be of cut or loop pile or a combination thereof, the rows of mending yarn produced in the selvedge must be uncut pile so that the dyed yarn ends can be pulled out for use in repairing as continuous lengths with segments of different colors therealong.

Many modifications will occur to those skilled in the art. Therefore, the invention is not limited to the specific form of the embodiment illustrated.

I claim:

1. Apparatus for dyeing yarn ends individually at predetermined positions along their lengths and manufacturing tufted carpeting therefrom to produce a predetermined multi-colored complex pattern therein comprising a series of troughs for different dye baths, means feeding a sheet of yarn ends from a supply to said baths in succession, dyeing means associated with each trough to cause segments of said yarn ends to receive dye from each trough, a plurality of banks of movable yarn guides for individual yarn ends or groups of yarn ends, there being at least one bank of yarn guides associated with each dyeing means, pattern control means to move each yarn guide individually to cause yarn carried by it to be dyed segmentally while a predetermined length of yarn passes, in combination with means feeding a group of mending yarn ends from said supply along a side of said sheet, means feeding said group of mending yarn ends over said baths, movable yarn guide means for at least one yarn end of said mending group, there being at least one mending yarn guide means associated wth each bath, and control means to cause said mending-yarn-guide means to move the yarn ends of said mending group and to cause them to be dyed segmentally while a predetermined length of yarn passes, and means to conduct said yarn sheet and said group mending yarn ends to a tufting machine, and a tufting machine having needles in which the individual yarn ends of said yarn sheet and said mending yarns are threaded, and by which the yarn ends are needled through a backing sheet to produce carpeting with the predetermined pattern.

2. Apparatus as claimed in claim 1 wherein said means which causes the yarn ends of said mending group to be dyed is separate from said pattern control means.

3. Apparatus as claimed in claim 1 having yarn drying means between said tufting machine and said dye troughs, and means to conduct said yarn sheet and said mending group of yarns through said drying means simultaneously.

4. Apparatus as claimed in claim 1 having means to conduct said yarn sheet and said mending group of yarns conjointly from said dyeing elements to and through the said tufting machine and its operations.

5. Apparatus as claimed in claim 1 in which yarn ends of said mending yarn group are fed along both sides of said yarn sheet.

6. Apparatus as claimed in claim 1 wherein said mending-yarn-guide means causes all of the yarn ends of a transversely aligned segment of the mending yarn group to be dyed one color simultaneously.

7. Apparatus as claimed in claim 1 wherein said control means and said mending-yarn-guide means cause all the yarn ends of a transversely-aligned segment of the mending yarn group to be simultaneously dyed one color and causes all yarn ends of a succeeding transversely aligned segment of the mending yarn group to be dyed a different color.

8. Apparatus as claimed in claim 1 wherein said dyeing means comprises dye pick-up means, and said pattern control means causes movement of said yarn guide means to cause yarn carried by it to engage said pick-up means while a predetermined length of yarn passes, and wherein said mending-yarn-guide means moves the mending yarn ends into engagement with said dye-pick-up means while a predetermined length of yarn passes.

9. Apparatus as claimed in claim 2 having yarn drying means between said tufting machine and said dye troughs, and means to conduct said yarn sheet and said mending group of yarns through said drying means simultaneously.

10. Apparatus as claimed in claim 3 having means to conduct said yarn sheet and said mending group yarns conjointly from said dyeing elements to and through the said tufting machine and its operations.

11. Apparatus as claimed in claim 6 having means to conduct said yarn sheet and said mending group of yarns conjointly from said dyeing elements to and through the said tufting machine and its operations.

12. Apparatus as claimed in claim 7 having means to conduct said yarn sheet and said mending group of yarns conjointly from said dyeing elements to and through the said tufting machine and its operations.

13. Apparatus as claimed in claim 1 wherein said means which causes the yarn ends of said mending group to be dyed is separate from said pattern control means and includes electroresponsive means to cause said movement of said mending yarn ends, and a continuous movable surface having thereon means to control the operation of said electro-responsive means.

14. Apparatus as claimed in claim 7 including electro-responsive means to cause said movement of said mending yarn ends, and a continuous movable surface having thereon means to control the operation of said electro-responsive means.

15. Apparatus as claimed in claim 8 wherein said means which causes the yarn ends of said group to engage said yarn pick-up means is separate from said pattern control means.

16. Apparatus for dyeing yarn ends individually at predetermined positions along their lengths and manufacturing tufted carpeting therefrom to produce a predetermined multi-colored complex pattern therein comprising a series of troughs for different dye baths, means feeding a sheet of yarn ends from a supply to said baths in succession, dyeing means associated with each trough to cause segments of said yarn ends to receive dye from each trough, a plurality of banks of movable yarn guides for individual yarn ends or groups of yarn ends, there being at least one bank of yarn guides associated with each dyeing means, pattern control means to move each yarn guide individually to cause yarn carried by it to be dyed segmentally while a predetermined length of yarn passes, in combination with means feeding a group of mending yarn ends from said supply along a side of said sheet, means feeding said group of mending yarn ends over said baths, movable yarn guide means for at least one yarn end of said mending group, there being at least one mending yarn guide means associated with each bath, and control means to cause said mending-yarn-guide means to move the yarn ends of said mending group and to cause them to be dyed segmentally while a predetermined length of yarn passes.

17. Apparatus as claimed in claim 16 wherein said means which causes the yarn ends of said mending group to be dyed is separate from said pattern control means.

18. Apparatus as claimed in claim 16 wherein said mending-yarn-guide means causes all of the yarn ends of a transversely aligned segment of the mending yarn group to be dyed one color simultaneously.

19. Apparatus as claimed in claim 16 wherein said control means and said mending-yarn-guide means cause all the yarn ends of a transversely-aligned segment of the mending yarn group to be simultaneously dyed one color and causes all yarn ends of a succeeding transversely aligned segment of the mending yarn group to be dyed a different color.

20. Apparatus as claimed in claim 16 wherein said means which causes the yarn ends of said mending group to be dyed is separated from said pattern control means and includes electro-responsive means to cause said movement of said mending yarn ends, and a continuous movable surface having thereon means to control the operation of said electro-responsive means.

* * * * *